US007874185B2

(12) United States Patent
Graute et al.

(10) Patent No.: US 7,874,185 B2
(45) Date of Patent: Jan. 25, 2011

(54) WASHING MACHINE AND BASE SYSTEM AND METHOD OF MAKING THE SAME

(75) Inventors: Bernhard Graute, Rietberg (DE); Eckhard Hellmer, Harsewinkel (DE); Joerg Kempe, Guetersloh (DE)

(73) Assignee: Miele & Cie KG., Guetersloh (DE)

( * ) Notice: Subject to any disclaimer, the term of this patent is extended or adjusted under 35 U.S.C. 154(b) by 1594 days.

(21) Appl. No.: 11/120,677

(22) Filed: May 3, 2005

(65) Prior Publication Data

US 2005/0241344 A1 Nov. 3, 2005

(30) Foreign Application Priority Data

May 3, 2004 (DE) ..... 10 2004 022 023

(51) Int. Cl.
*D06F 37/00* (2006.01)

(52) U.S. Cl. ..... 68/3 R; 68/235 R

(58) Field of Classification Search ..... None
See application file for complete search history.

(56) References Cited

U.S. PATENT DOCUMENTS 5,667,065 A * 9/1997 Fahrion ..... 206/599
5,957,557 A * 9/1999 Langer et al. ..... 312/223.6
6,585,225 B1 7/2003 Lake

FOREIGN PATENT DOCUMENTS

| | | |
|---|---|---|
| DE | 196 31 639 A1 | 2/1998 |
| DE | 198 32 675 A1 | 1/2000 |
| DE | 19838630 | 3/2000 |
| DE | 203 02 572 U1 | 5/2003 |
| EP | 0943721 A1 | 9/1999 |

* cited by examiner

*Primary Examiner*—Michael Kornakov
*Assistant Examiner*—Eric Golightly
(74) *Attorney, Agent, or Firm*—Leydig, Voit & Mayer, Ltd.

(57) ABSTRACT

A system for stacking a laundry treatment machine provided with a bottom panel of predetermined three-dimensional configuration onto a pedestal or the like provided with a support surface of a complementary three-dimensional configuration. The bottom panel is preferably made of sheet metal of a predetermined thickness or gauge, and the support surface is made of a sheet metal of lesser thickness or gauge.

7 Claims, 2 Drawing Sheets

WASHING MACHINE AND BASE SYSTEM AND METHOD OF MAKING THE SAME

BACKGROUND OF THE INVENTION

1. Field of the Invention

The present invention relates to a novel system consisting of a laundry treatment machine such as a washing machine, washer-dryer or dryer provided a housing which includes a stamped sheet metal bottom panel and of a pedestal which includes lateral frame and/or housing components and a support surface for receiving the laundry treatment machine. Moreover, the invention relates to a method of making such a system.

European patent specification EP 0,943,721 A1 discloses a laundry treatment machine manufactured by a so-called frame construction. It involves assembling a sheet metal bottom panel, two L-shaped angular frame elements and a cross into a support frame for receiving the functional components of the machine and which is thereafter enclosed by covering panels such as a front wall, side walls and a lid.

German patent specification DE 198 32 675 A1 discloses a pedestal consisting of a box-like sub-structure on which a laundry treatment machine may be positioned. It is intended to increase the working height of the machine and to provide an ergonomic improvement for the user.

Moreover, German utility model DE 203 02 572 U1 discloses a pedestal with a drawer for a washing machine . In this case, the edges and corner areas of the surfaces are structured as U-shaped profiles or pipes of rectangular cross-section to ensure the required stability.

From German patent specification DE 196 31 639 A1 a system of stackable kitchen appliances and kitchen furniture is known. In this case, tubular reinforcements are used which defined the coupling sites for any further appliance or furniture.

Since there is little demand for such pedestals, their manufacture is relatively dear in view of the fact that the costs of their tools have to be apportioned to low quantities. Also, their structure must provide the stability necessary for the weight of 100 kg of a washing machine.

OBJECT OF THE INVENTION

It is, therefore, an object of the present invention to provide a system of the kind referred to which while economical provides structural stability.

Another object of the invention is to provide a novel method of making such a system.

Other object will in part be obvious and will in part appear hereinafter.

BRIEF SUMMARY OF THE INVENTION

In a preferred embodiment, the object is accomplished by a system of the kind referred to which is provided with a pedestal including a stamped sheet metal bottom panel of predetermined configuration and by a laundry treatment machine provided with a bottom panel of a substantially similar or complementary configuration.

The method of producing the system is accomplished by stamping the bottom panels for the pedestal and for the laundry treatment machine by the same stamping or clicking machine.

The advantages to be derived from the practice of the invention are the result from the fact that components are being used for manufacturing the pedestal which in terms of their stability have been proven in connection with washing machines. In addition, because of the large number their manufacturing costs are relatively low.

In an advantageous embodiment of the invention the bottom panel of the pedestal is made of sheet metal which is thinner than the sheet metal used for bottom panels of laundry treatment machines. In this manner it is possible, in addition to the savings derived from using the same tools for bottom panels of both laundry treatment machines and the pedestals, to generate further savings as a result of lower material costs for the pedestals.

In a useful embodiment, the pedestal is provided with a drawer at its front side.

DESCRIPTION OF THE SEVERAL DRAWINGS

DETAILED DESCRIPTION OF THE PREFERRED EMBODIMENTS

Figure 1:
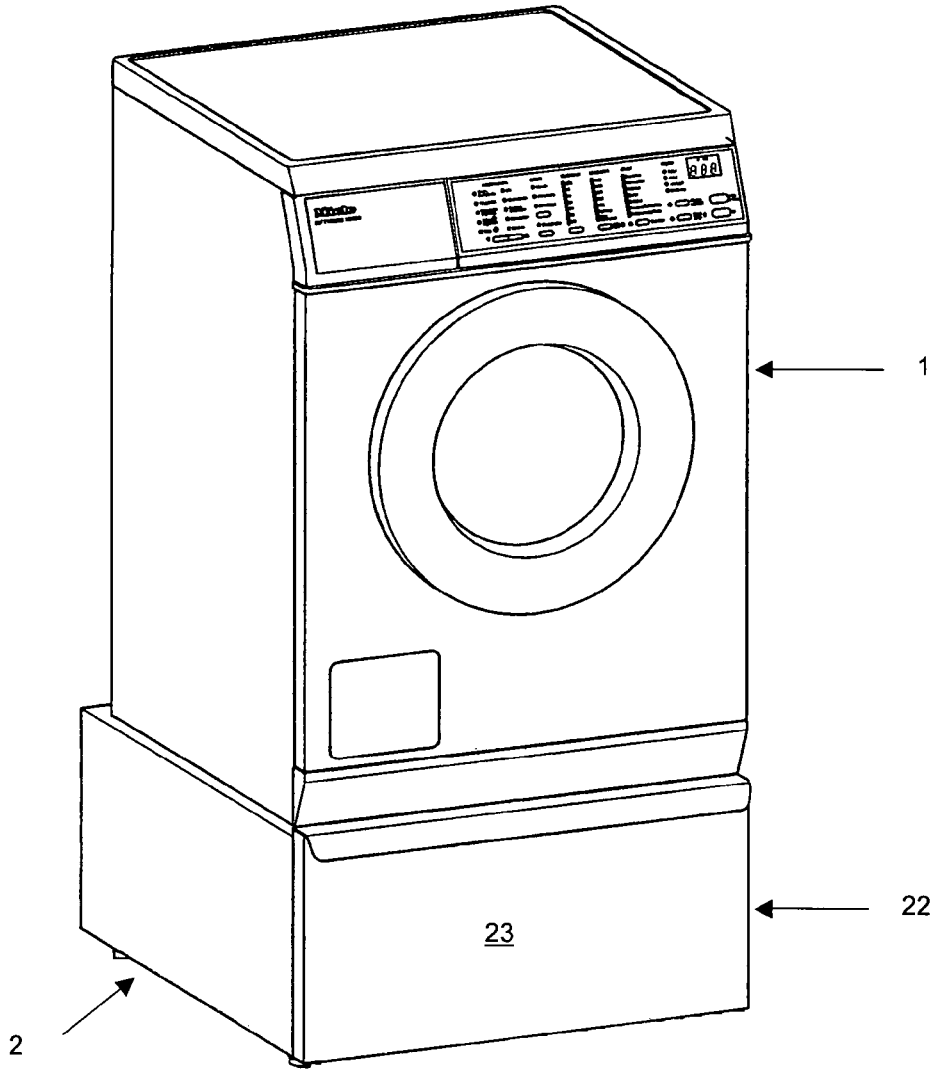
FIG. 1 is a perspective view of the entire system consisting of a pedestal and a washing machine positioned thereon.
Figure 4:
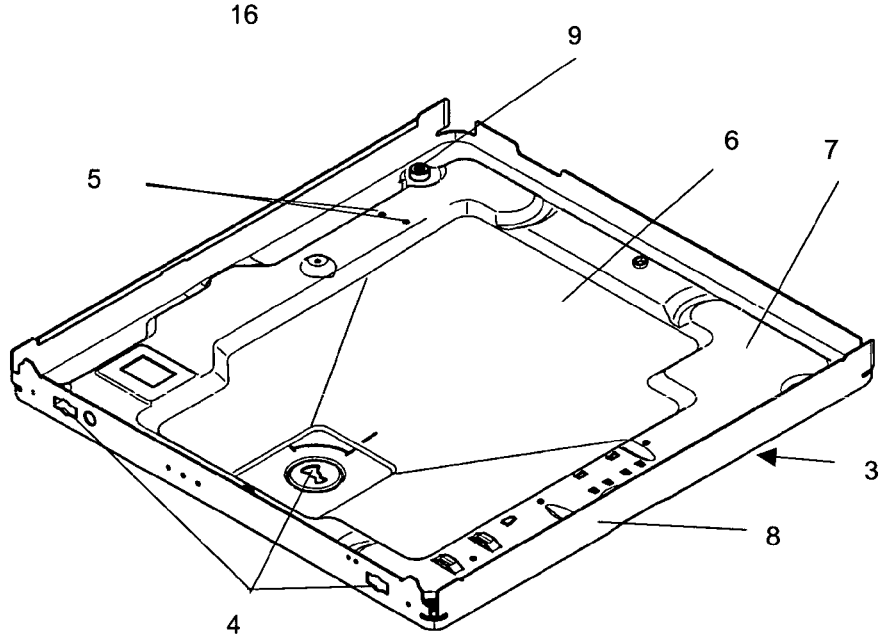
FIG. 4 depicts the bottom sheet metal panel of the pedestal or washing machine as an individual component.

The household washing machine 1 shown in FIG. 1 is positioned on a pedestal 2 and connected therewith in a manner to be described. The structure of such a washing machine is sufficiently known from European patent specification EP 0,943,721 A1 and is, therefore, neither shown nor described in any detail. Its housing is manufactured as a frame structure, the frame including, among other components, a sheet metal bottom panel. In the context of the invention, it is only the manufacture of this sheet metal bottom panel 3 which is important and which shown in detail in FIG. 4. Initially, it is severed by a punching or clicking operation as one piece from a coil of sheet metal (not shown) and provided with the required cut-outs 4 and openings 5. Thereafter, recesses 6 and protrusions 7 are formed in a multiple step stamping operation by a stamping process by one or more stamping tools. In this manner, a circumferential margin 8 is formed in the sheet metal bottom panel 3. In addition, stamped nuts 9 for the reception of machine feet 10 (see FIGS. 1 and 2) are formed during this process.

Figure 2:
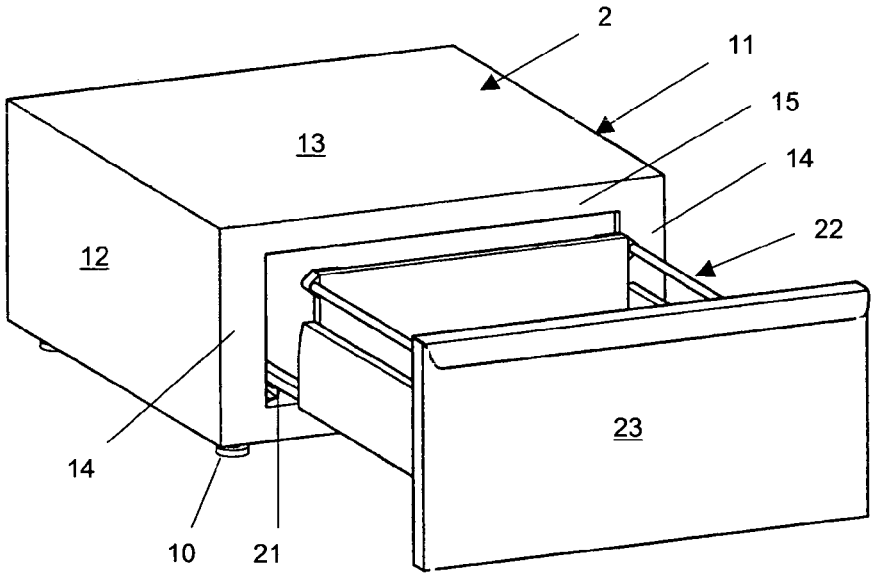
FIG. 2 depicts the pedestal of FIG. 1 with pulled-out drawer.
Figure 3:
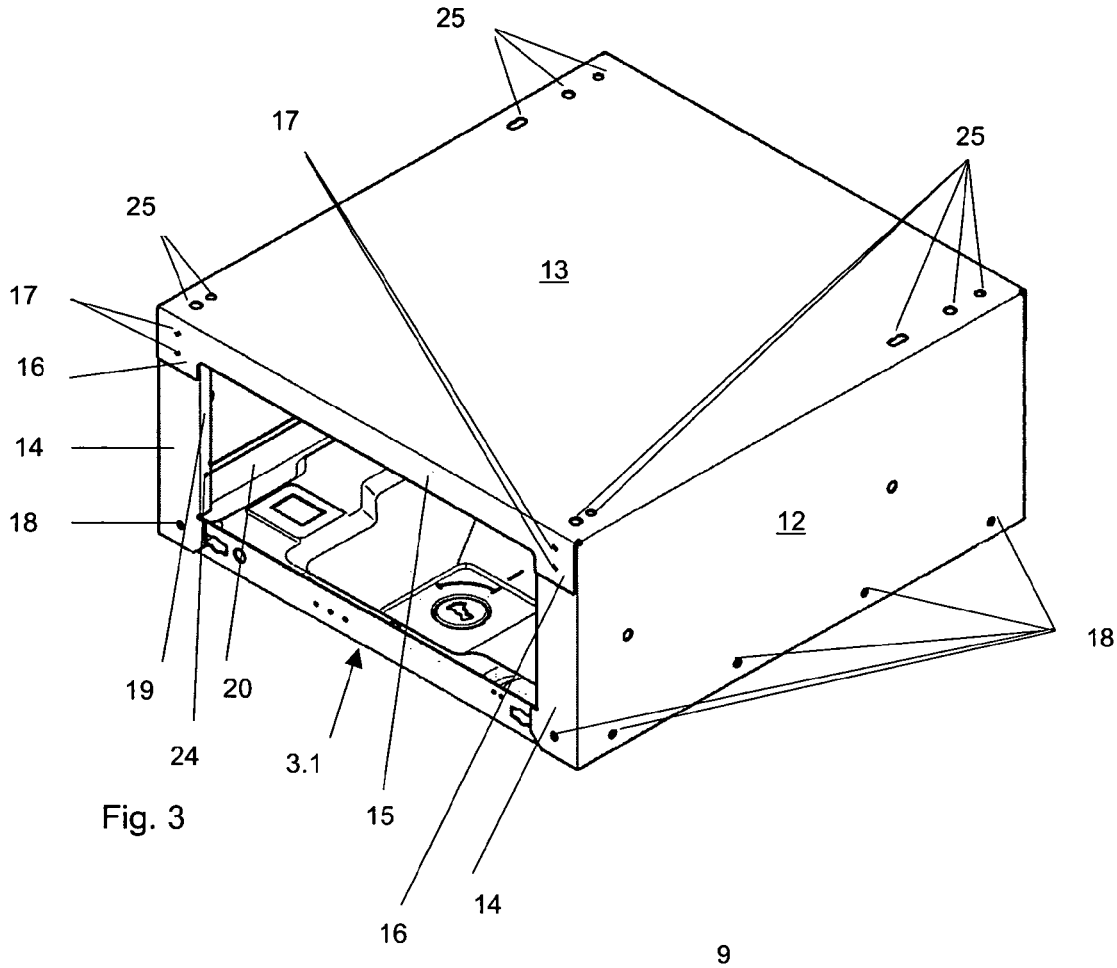
FIG. 3 depicts the pedestal of FIG. 2 without the drawer.

For manufacturing the pedestal 2 shown as a single component in FIGS. 2 and 3 a sheet metal bottom panel 3.1 is used which is subjected to a similar shaping process as the sheet metal bottom panel 3 of the washing machine 1. Since it need not be quite as stable or sturdy as the bottom panel of the washing machine 1 the bottom panel 3.1 may be made of thinner sheet metal. A unitary body 11 constitutes a further component of the pedestal 2. It constitutes the two side walls 12 and a supporting surface 13 for the washing machine 1. This component, too, is initially cut by punching from a coil of sheet metal and provided with a pattern of openings the function of which will be described hereinafter. Thereafter, the side walls 12 are folded, and a marginal strip 14, 15 is folded down from the front as well as rear of the supporting surface 13. In their overlapping area 16, these marginal strips are joined by clinch connections 17. The body 11 is connected to the bottom panel 3.1 by blind rivets 18. Thereafter, a flat panel (not shown) is screwed to the rear of the body 11 to close it.

The marginal strips 14 of the side walls 12 are bent inwardly by a further chamfering operation. In this manner, they form abutments 19 for threadedly connecting two lateral sheet metal fastening panels 20 which in turn are each provided with a telescoping rail 21. The rails 21 serve to receive a drawer 22 shown in FIG. 1 in its inserted state and in FIG. 2 in its withdrawn state. The structure of such a drawer 22 is generally known and is not, therefore, described here in any detail. It is to be mentioned, however, that the front panel 23 of the drawer 22 is dimensioned such that is it completely covers the front side of the pedestal 2.

In its front section, the telescoping rail 21 is fastened to the chamfer 19 of the pedestal as well ass to the fastening panel 20. To this end, both components are provided with consecutively positioned bores of which FIG. 3 only shows bore 24 at the chamfer 19. The added fastening of the telescoping rail 21 at the pedestal 2 provides for a defined alignment of the front panel 23 relative to the edges of the pedestal 2.

For erecting the system, feet 10 usually screwed into the bottom panel 3 of the washing machine 1 are removed therefrom and threaded into the stamped nuts in the bottom panel 3.1 of the pedestal 2. Threaded pins (not shown) are screwed into the stamped nuts 9 in the bottom panel 3 of the washing machine 1. Thereafter, the washing machine 1 is aligned relative to the support surface 13 such that the threaded pins protrude into corresponding bores 25 in the surface 13. To connect the washing machine 1 to the pedestal 2 each threaded pin is secured by a nut screwed onto the pin in the interior of the pedestal 2. The numerous bores 25 are provided for the accommodation of various types of machines.

What is claimed is:

1. A system, comprising:

a laundry processing machine comprising a bottom panel of a stamped predetermined three-dimensional configuration; and a pedestal comprising a bottom panel of a stamped three-dimensional configuration substantially similar to the configuration of the bottom panel of the laundry processing machine.

2. The system of claim 1, wherein the bottom panel of the laundry processing machine and the bottom panel of the pedestal are each made of sheet metal.

3. The system of claim 2, wherein the sheet metal of the bottom panel of the pedestal is thinner than the sheet metal of the bottom panel of the laundry processing machine.

4. The system of claim 1, wherein the three-dimensional configuration of the bottom panel of the laundry processing machine and of the bottom panel of the pedestal is generated by one stamping machine.

5. A system comprising:

a laundry processing machine comprising a bottom panel having a stamped three-dimensional configuration; and a pedestal comprising a bottom panel having a stamped three-dimensional configuration, wherein the stamped three-dimensional configuration of the bottom panel of the laundry processing machine is substantially identical to the stamped three-dimensional configuration of the bottom panel of the pedestal.

6. The system of claim 5, wherein the bottom panel of the laundry processing machine and the bottom panel of the pedestal are each made of sheet metal.

7. The system of claim 6, wherein the sheet metal of the bottom panel of the pedestal is thinner than the sheet metal of the bottom panel of the laundry processing machine.

* * * * *